US005604940A

United States Patent [19]

Shimizu

[11] Patent Number: 5,604,940

[45] Date of Patent: Feb. 25, 1997

[54] MOVABLE BATHTUB UNIT HAVING A FUNCTION OF EMITTING AIR-BUBBLE JET

[75] Inventor: Hideo Shimizu, Toshima-ku, Japan

[73] Assignee: Cappeline Buono, Tokyo, Japan

[21] Appl. No.: 408,071

[22] Filed: Mar. 22, 1995

[30] Foreign Application Priority Data

Feb. 10, 1995 [JP] Japan ..... 7-022589

[51] Int. Cl.[6] ..... A47K 3/00

[52] U.S. Cl. ..... 4/541.1

[58] Field of Search ..... 4/541.1–541.5, 4/584, 593–595, 525

[56] References Cited

U.S. PATENT DOCUMENTS

| | | | |
|---|---|---|---|
| 2,751,602 | 6/1956 | Wilkerson | 4/594 |
| 4,785,484 | 11/1988 | Sargent | 4/541.4 |
| 4,797,958 | 1/1989 | Guzzini | 4/541.2 |
| 4,857,112 | 8/1989 | Franninge | 4/541.1 X |
| 4,924,069 | 5/1990 | Giordani | 4/541.4 X |
| 5,236,581 | 8/1993 | Perry | 4/541.1 X |
| 5,267,359 | 12/1993 | Clark | 4/541.3 X |

FOREIGN PATENT DOCUMENTS

| | | | |
|---|---|---|---|
| 2673837 | 9/1992 | France | 4/525 |
| 2701842 | 9/1994 | France | 4/541.3 |
| 0941936 | 3/1964 | United Kingdom | 4/584 |

*Primary Examiner*—Charles E. Phillips
*Attorney, Agent, or Firm*—Wenderoth, Lind & Ponack

[57] ABSTRACT

A movable bathtub unit having a bathtub covered with a jacket receptacle is integrally assembled with bubble-jet producing equipment for emitting a jet of air bubbles or hot water into the bathtub so as to facilitate its transportation and installation. The bathtub further includes equipment for injecting various bath liquids or an aromatic or for illuminating the inside of the bathtub so as to render bathing more enjoyable.

13 Claims, 8 Drawing Sheets

MOVABLE BATHTUB UNIT HAVING A FUNCTION OF EMITTING AIR-BUBBLE JET

BACKGROUND OF THE INVENTION

1. Field of the Invention:

This invention relates to a movable or portable bathtub unit with a bubble-jet mechanism for emitting a jet of air bubbles and/or hot water into a hot bath.

2. Description of the Prior Art

Nowadays, a style of bathing while applying a jet of air bubbles and/or hot water to the body of a person soaking in a hot bath has become to popular for bringing about the massaging effect to improve the circulation of the blood. There are known two types of so-called bubble-jet bath systems for practicing the aforesaid bathing style, i.e., one of the conventional bubble-jet bath systems is a portable jet bath unit capable of being detachably attached to an existing stationary bathtub, and the other type is a bath system comprising a stationary bathtub and a bubble-jet producing device fixedly integrated to the bathtub.

Although the former portable bath system is made compact for carrying convenience, it cannot produce an intense jet of air bubbles or hot water having a jet pressure sufficient to effectively massage a person in the bath.

The latter stationary bathtub system is advantageous in producing a jet of air bubbles or water having sufficient jet pressure, but it is restricted in its installation in a bathroom. That is, the installation of the system in the bathroom inevitably calls for massive operations of altering a bathroom construction and bringing the bathtub integrated with the bubble-jet producing device into the bathroom, which are much harder and frequently either impossible or very difficult.

To be more specific, in order to install the stationary bathtub system in a bathroom, a sufficient space for accommodating driving means including an electric motor and a jet pump must be secured, and piping for supplying a jet of air bubbles and/or hot water must be adequately arranged. Besides, maintainance and repair of a bubble-jet producing device mounted on the conventional stationary bathtub system is very difficult of maintenance and repair.

Furthermore, there has been a need for a movable bathtub unit having a function of emitting a jet of air bubbles and/or hot water, which can be conveniently used even outdoors for enjoying open-air recreation. However, there has not existed a portable bubble-jet bath unit having good durability and ability to produce a powerful jet of air bubbles or hot water.

Although the conventional portable bathtub unit has only a function of emitting a jet of air bubbles or hot water, there has not been found a bathtub unit of this type having pleasant ornamental subsidiaries such as apparatus for illuminating the hot water in the bath and pouring various bath liquids or an aromatic into a bathtub. In particular, incorporation of a lighting apparatus into the bathtub has been only with proposed hesitation in view of the danger of an electricity leak and electric shock.

OBJECT OF THE INVENTION

The present invention was made in view of the foregoing conventional situation and has an object to provide a convenient bathtub unit having an excellent function capable of emitting an intense jet of air bubbles or hot water and of being easily moved.

Another object of this invention is to provide a movable bubble-jet bathtub unit capable of being readily transported to any place and easily assembled and installed without specific piping work.

Still another object of this invention is to provide a movable bubble-jet bathtub unit that is easy to handle, repair and preserve.

Yet another object of this invention is to provide a movable bubble-jet bathtub unit having a function of introducing various bath liquids or an aromatic into a bathtub.

A further object of this invention is to provide a movable bubble-jet bathtub unit having lighting means for illuminating the inside of the bathtub so as to render bathing more enjoyable.

SUMMARY OF THE INVENTION

To attain the objects described above according to the present invention, there is provided a movable bathtub unit comprising a bathtub, a jacket receptacle for receiving the bathtub with an accommodating space defined between the receptacle and the bathtub, and bubble-jet producing equipment for emitting a jet of air bubbles or hot water into the bathtub, which equipment is placed in the accommodating space between the bathtub and the jacket receptacle.

The bathtub and the jacket receptacle are integrally united so as to cover the entire outside of the bathtub with the jacket receptacle. The bathtub unit can be easily carried in or out and installed at a given location by simple operations and without the need for water supply hook-up and with simple portable electricity hook-up.

The bathtub is formed in a substantially ship bottom shape having at least one slopping side wall serving as a backrest for supporting the back of a person soaking in the bathtub. Between the backrest and the jacket receptacle, the accommodating space for the bubble-jet producing equipment can be sufficiently defined.

The jacket receptacle is provided on its lower surface with damper leg stands for assuring the stability of installation of the bathtub or casters for facilitating movement of the bathtub unit.

The bubble-jet producing equipment may comprise an air blowing pump connected to bubble jet nozzles disposed in the side and/or bottom surfaces of the bathtub. Each bubble jet nozzle has a check valve for preventing hot water in the bathtub from flowing backward into the air blowing pump.

The bubble-jet producing equipment may further include means for injecting various bath liquids or an aromatic into a bathtub or illuminating the inside of the bathtub. The illuminating means has a light source connected to the side wall of the bathtub through optical fibers so as to prevent a danger of a short circuit, electric shock and so Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

Figure 1:
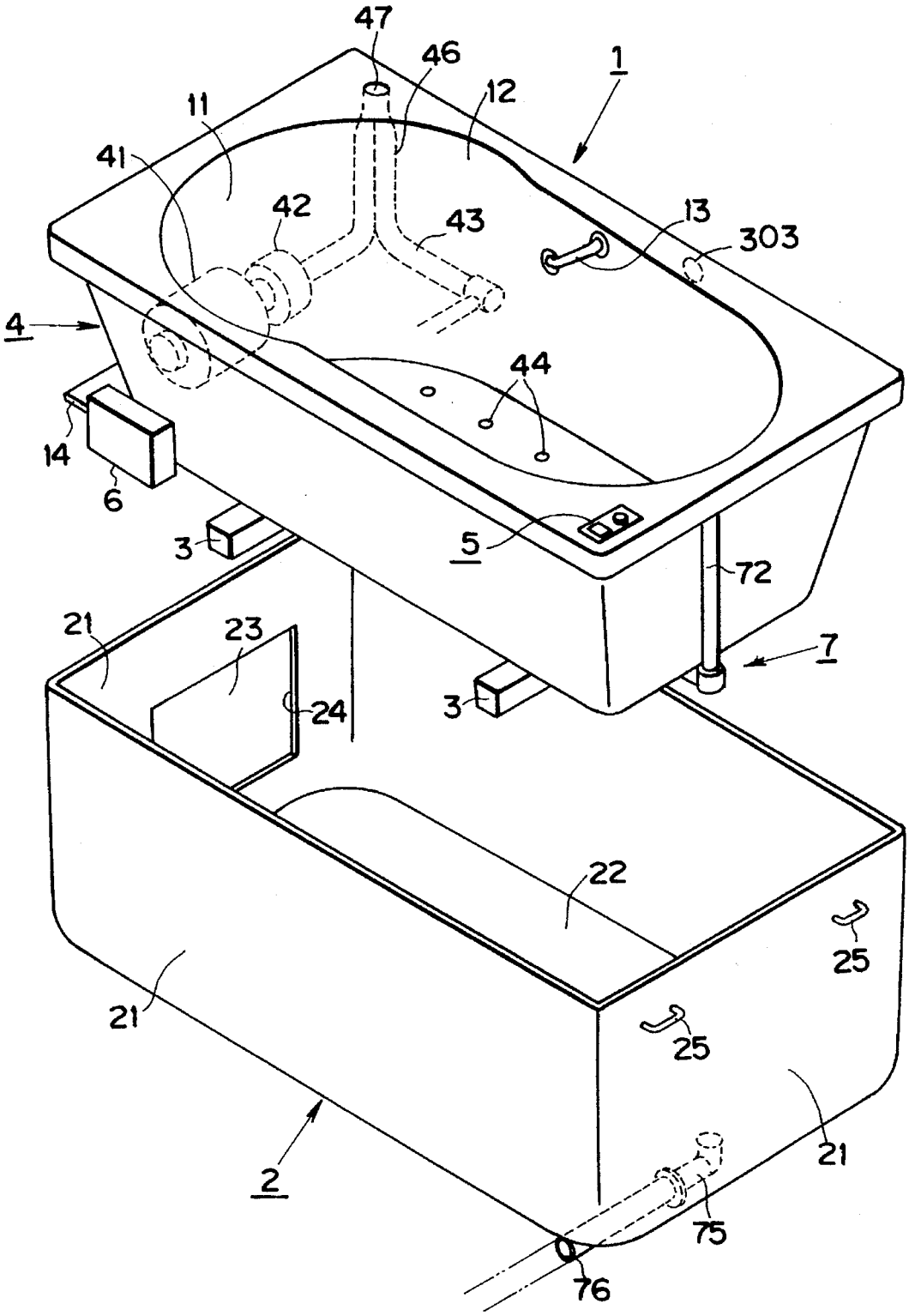
FIG. 1 is an exploded perspective view showing one embodiment of a movable bathtub unit according to this invention.

The bathtub unit illustrated in FIGS. 1 through 4 as the first embodiment of the present invention comprises a bathtub 1 for containing hot water, a jacket receptacle 2 for receiving the bathtub 1, support beams 3, bubble-jet producing equipment 4, a control panel 5, a driving controller 6, a drain system 7, and damper leg stands 8.

The bathtub 1 in this embodiment is formed in a substantially shallow ship bottom shape having an inner space with a substantially trapezoidal cross section. The inner space of the bathtub 1 is defined by four gently curved side walls, namely, a front side wall, two lateral side walls and a back side wall, having smooth surfaces. One of the side walls, i.e. the back side wall, has a relatively large angle of inclination so as to form a backrest 11 for supporting the back of the person soaked in the bathtub. Moreover, the bathtub 1 is provided on its inner surface with inwardly swelling arm rests 12 and a hand grip 13, but the arm rests 12 and hand grip 13 are by no means necessary to this invention and may be omitted.

The bathtub 1 may be formed in one body of stainless steel or fiber-reinforced thermoplastic (FRP) such as glass-fiber reinforced polyester and acrylic synthetic resin.

The bathtub 1 has a curved flange 1*a* with an upper flat surface, which is formed by bending an upper peripheral edge portion in an inverted substantially U-shape.

The jacket receptacle 2 is formed in a substantially rectangular parallelepiped shape having an upper opening so as to place the bathtub 1 thereinside and cover the outer peripheral side and bottom surfaces of the bathtub 1 with the side walls 21 and bottom 22 of the jacket receptacle 2.

When the bathtub 1 is placed inside the jacket receptacle 2, the upper peripheral edge 2*a* of the jacket receptacle 2 is fitted into the curved flange l*a* of the bathtub 1. The bathtub 1 and the jacket receptacle 2 may be steadily united by joining with adhesive or welding along the butt portion at which the upper peripheral edge 2*a* comes into contact with the curved flange l*a*.

As stated above, the bathtub 1 and the jacket receptacle 2 assume the double-wall structure so as to make a relatively large back accommodating space S1 behind the backrest 11, i.e. between the backrest 11 of the bathtub 1 and the back side wall of the jacket receptacle 2. Still more, there are defined side spaces S2 between the opposite lateral sides of the bathtub 1 and the side walls of the jacket receptacle 2, and a bottom space S3 between the bottoms of the bathtub 1 and the bottom of the jacket receptacle 2, respectively.

Figure 2:
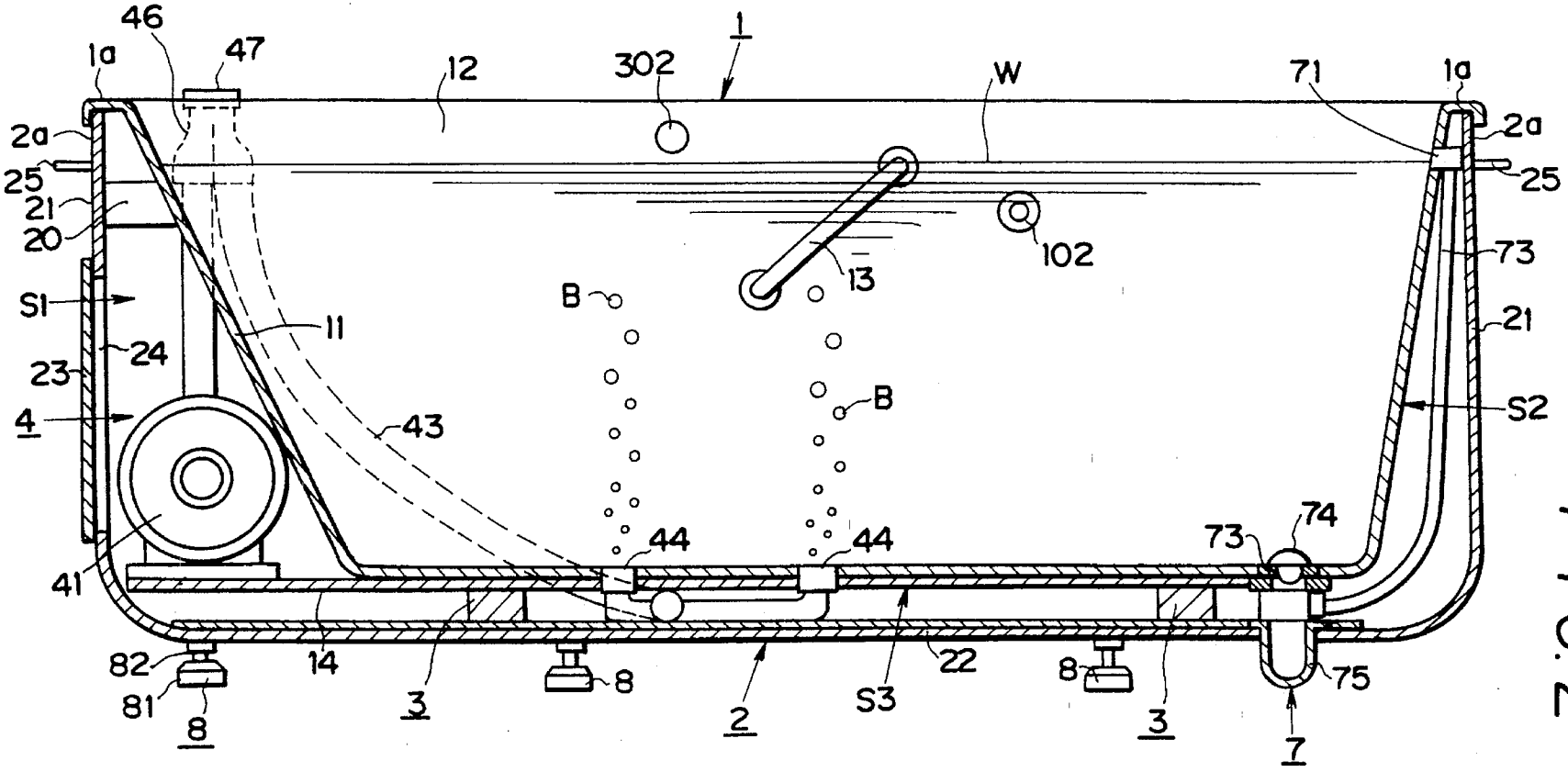
FIG. 2 is a cross sectional view showing the assembled state of the bathtub unit of FIG. 1.
Figure 3:
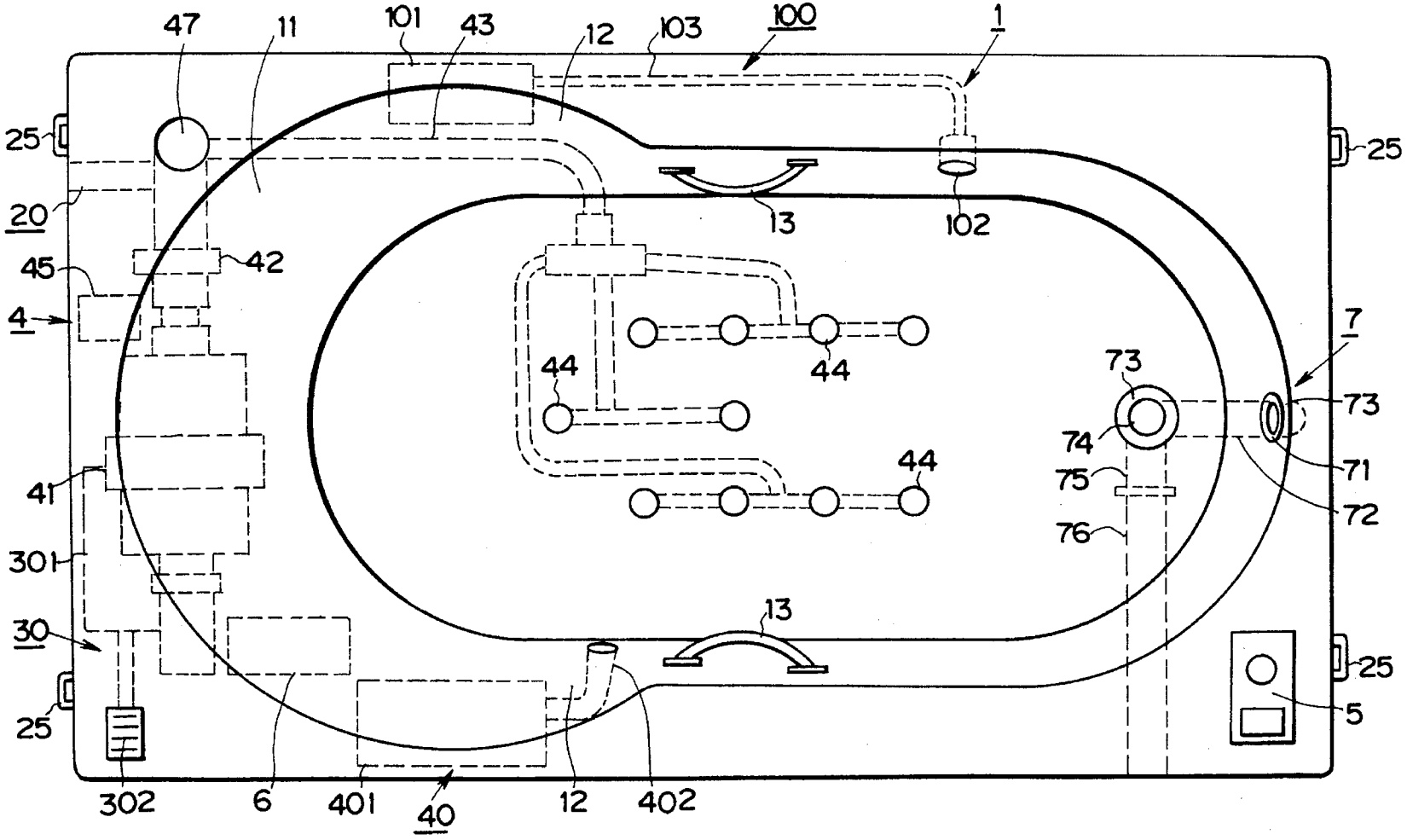
FIG. 3 is a plan view showing the assembled state of the bathtub unit of FIG. 1.

The angle of inclination of the backrest 11 of the bathtub 1 may be determined within the range of about 100° to 150° relative to the bottom of the bathtub, preferably, about 120° as shown in FIG. 2. The back side wall 21 of the jacket receptacle 2 opposite to the backrest 11 of the bathtub has an inspection hole 24 closed with a cover 23 in a normal state. It is convenient to mount carrying handles 25 on the opposite upper portions of the jacket receptacle 2.

The support beams 3 are disposed between the bottom plate 14 attached to the bottom of the bathtub 1 and the bottom plate 22 disposed on the bottom of the jacket receptacle 2 to secure the bottom space S3.

The bubble-jet producing equipment 4 is placed on the bottom plate 14 in the back accommodating space S1. This equipment 4 includes an air blowing pump 41 for sucking or draining in the open air and forcibly discharging the air, a pressure control valve 42 for controlling the pressure of air flowing through a pipe 43 extending from the air blowing pump 41 to the bathtub 1, and a cord reel 45 for an electric cord. The air blowing pump 41 is driven by electric current supplied through the electric cord.

The pipe 43 from the air blowing pump 41 is laid in the side space S2 and bottom space S3 and connected to bubble jet nozzles 44 disposed in the side and bottom walls of the bathtub 1 at regular intervals.

The pipe 43 extending from the air blowing pump 41 is raised to the flange portion l*a* of the bathtub 1, and there, is open to the air to form a hole 47 in the flange portion l*a*. From the hole 47, the pipe 43 extends downward and branches out into branch pipes directly connected to the bubble jet nozzles 44. The hole 47 is closed with a cap at ordinary times and can easily can be opened for cleaning, draining or inspection.

Figure 4:
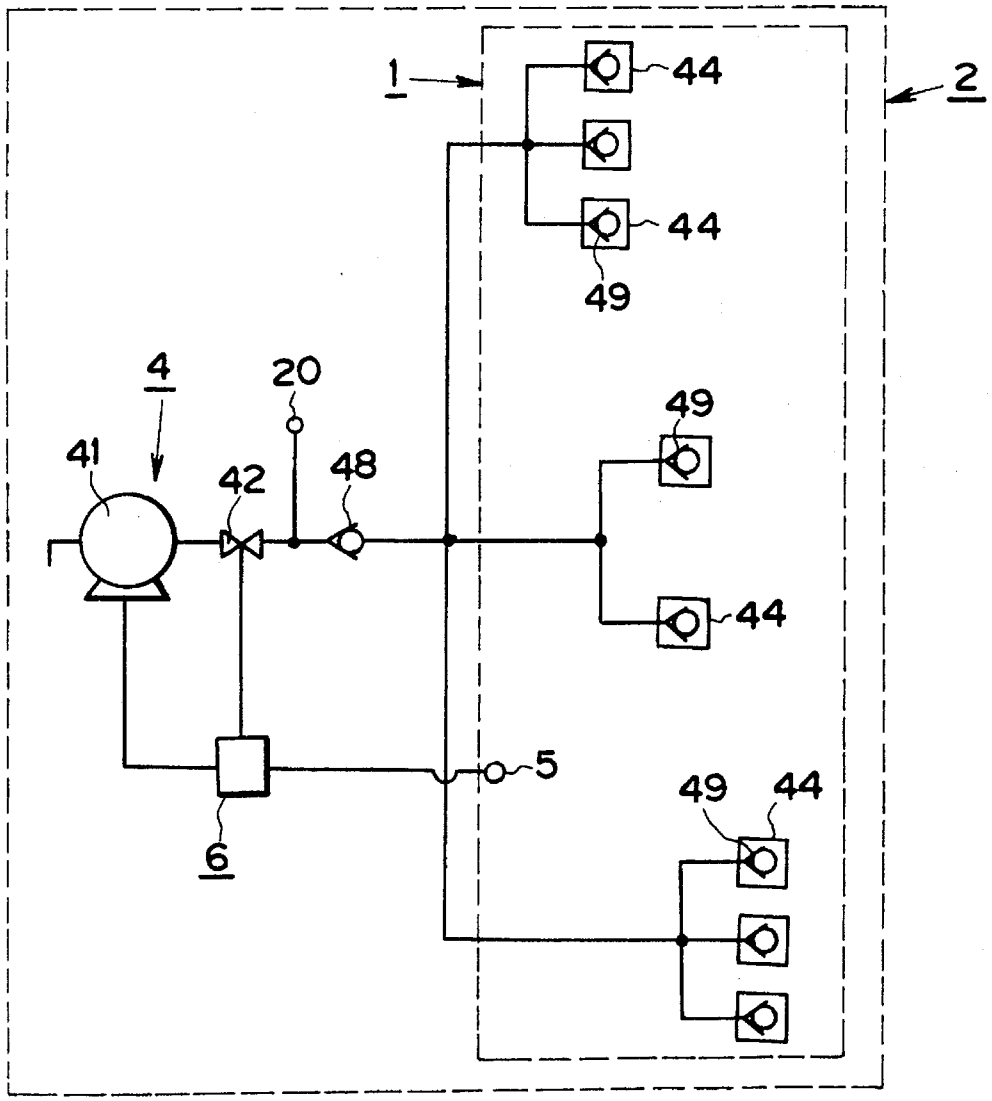
FIG. 4 is a piping diagram of the movable bathtub unit of FIG. 1.

As schematically illustrated in FIG. 4, there are incorporated a check valve 48 in the pipe 43 extending out of the valve 42 and check valves 49 in the bubble jet nozzles 44 for preventing the hot water in the bathtub 1 from flowing backward to the air blowing pump 41.

The control panel 5 is disposed on the flange portion 1*a* of the bathtub 1 for controlling the operation of the air blowing pump 41 and has switching means for actuating the driving controller 6 to drive the air blowing pump 41.

The driving controller 6 is connected to the air blowing pump 41 of the bubble-jet producing equipment 4 and the pressure control valve 42, so that the air blowing pump 41 and pressure control valve 42 can be controlled in response to the manual operation of the control panel 5.

The drain system 7 for draining the bathtub includes a drain port 71 formed in the front side wall of the bathtub 1, a drain port 73 formed in the bottom of the bathtub 1, a drain pipe 72 connected between the drain ports 71 and 73, and a drain pipe 75 extending out of the bathtub unit through the bottom 22 of the jacket receptacle 2.

The damper leg stands 8 are attached to the bottom of the jacket receptacle 2. Each damper leg stand 8 includes a damping structure for preventing vibrations or shocks from being transmitted between the bathtub and a floor on which the bathtub unit is installed. For fulfilling the shock-absorbing function, stand 8 may be made of a damping material such as porous metal, rubber and hard plastics. For example, the leg stand 8 may comprise a ground pad 81 made of rubber, and a support shaft 82 of metal or ceramics. The support shaft 82 has a screw thread, so that the height of the shaft 82 can be adjusted by being rotated to hold the bathtub 1 in the horizontal position.

The bathtub unit in this embodiment has illuminating means 100, and bath liquid injecting means 20.

The illuminating means 100 comprises a light source 101 disposed in the back accommodating space S1 at a distance from the bathtub 1, light projecting means 102 for illuminating the interior of the bathtub 1, and optical fibers 103 laid in the side spaces S2 for connecting the light source 101 with the light projecting means 102.

The light projecting means 102 may include color filters so as to decoratively illuminate the bathtub 1 with various colored lights.

Thus, since the electrically actuated light source 101 is disposed apart from the bathtub, a risk of a short circuit, electric shock and the like caused due to leakage of hot water from the bathtub can be avoided. The bath liquid injecting means 20 for pouring various bath liquids or an aromatic into the bathtub is attached to raised portion 46 of the pipe 43. The bath liquid injecting means 20 can be handled by a manual operation, but may be electrically operated by use of an electric pump (not shown) to forcibly inject the bath liquids into the bathtub.

The bathtub unit in this embodiment is further provided with a steam mechanism 30 and a filter mechanism 40.

The steam mechanism 30 includes a steam producing device 301 placed in the back accommodating space S1. Steam produced by the steam producing device 301 is sent to a steam mouth 302 formed in the upper flat surface of the flange 1*a* of the bathtub 1 and spouted out therefrom.

The filter mechanism 40 comprises a filter unit 401 placed in the back accommodating space S1 and including a filter for filtrating and cleaning hot water W in the bathtub and a pump for circulating the hot water, and a conduit 402-for connecting the bathtub 1 with the filter unit 401 so as to circulate the hot water W from the bathtub 1 to the filter unit 401. It is desirable to let the filter in the filter unit 401have a function of decomposing bacteria in the hot water.

As described above, according to this embodiment, the bathtub 1 united with the jacket receptacle 2 can be freely carried to any place along with the bubble-jet producing equipment 4. Since the portion in which the bubble-jet producing equipment 4 is disposed does not protrude out of the bathtub 1, the bathtub unit of this invention is easy to carry and can be given a smart appearance. Upon transport in the bathtub unit to a desired location, the bathtub unit can be easily used merely by connecting a lengthening drain pipe 76 to the drain pipe 75, making an electric connection and introducing an adequate amount of hot water into the bathtub 1.

The operation of the bubble-jet producing equipment 4 is manually controlled by using the control panel 5. By turning on the switch of the control panel 5, the air blowing pump 41 of the bubble-jet producing equipment 4 is driven to emit a jet of air bubbles B into the hot water W in the bathtub. The jet of air bubbles B runs against the body of a person in the-bath to produce a massaging effect. While driving the bubble-jet producing equipment 4, the amount or intensity of air bubbles emitted into the bathtub can be arbitrarily adjusted by operating the control panel 5.

Excess hot water in the bathtub flows out from the drain port 71 through the drain pipes 72, 75 and 76. Therefore, even if the surface of the hot water in the bathtub is excessively elevated when the person soaks in the bathtub, the hot water neither overflows nor enters into the space defined between the bathtub 1 and the jacket receptacle 2. Thus, the fear of water leaking and contacting electrical components can be avoided. The vibrations or noises produced in driving the air blowing pump 41 are effectively absorbed by the damper leg stands 8 having a damping function.

When the bubble-jet producing equipment 4 ceases to emit the jet of air bubbles into the bathtub by turning off the switch of the control panel 5, the hot water in the bathtub is apt to flow into the pipe 43, but the check values 49 prevent the hot water in the bathtub from flowing backward. Even if the hot water in the bathtub flows into the pipe 43 through the check valve 49, it in no way reaches the air blowing pump due to of the raised portion 46 of the pipe 43.

The cap with which the hole 47 formed in the raised portion 46 of the pipe 43 is closed at ordinary times can be opened when performing cleaning, draining or inspection of the pipe 43.

The illuminating means 100, bath liquid injecting means 20 which gives out a fragrant smell, steam mechanism 0, and filter mechanism 40 are also controlled by operating the control panel 5. The visual effect of the illuminating means 100 and the fragrant ambience brought about by the bath liquid injecting means 20 will relax pleasantly the person bathing in the hot water in the bathtub. In place of the aromatic, a bath detergent for cleaning the bathtub may be supplied into the bathtub from the bath liquid injecting means 20. By operating the steam mechanism 30, the bath can be used as a sauna bath, and by operating the filter mechanism 40, many people can use the bath refreshinly.

Figure 5:
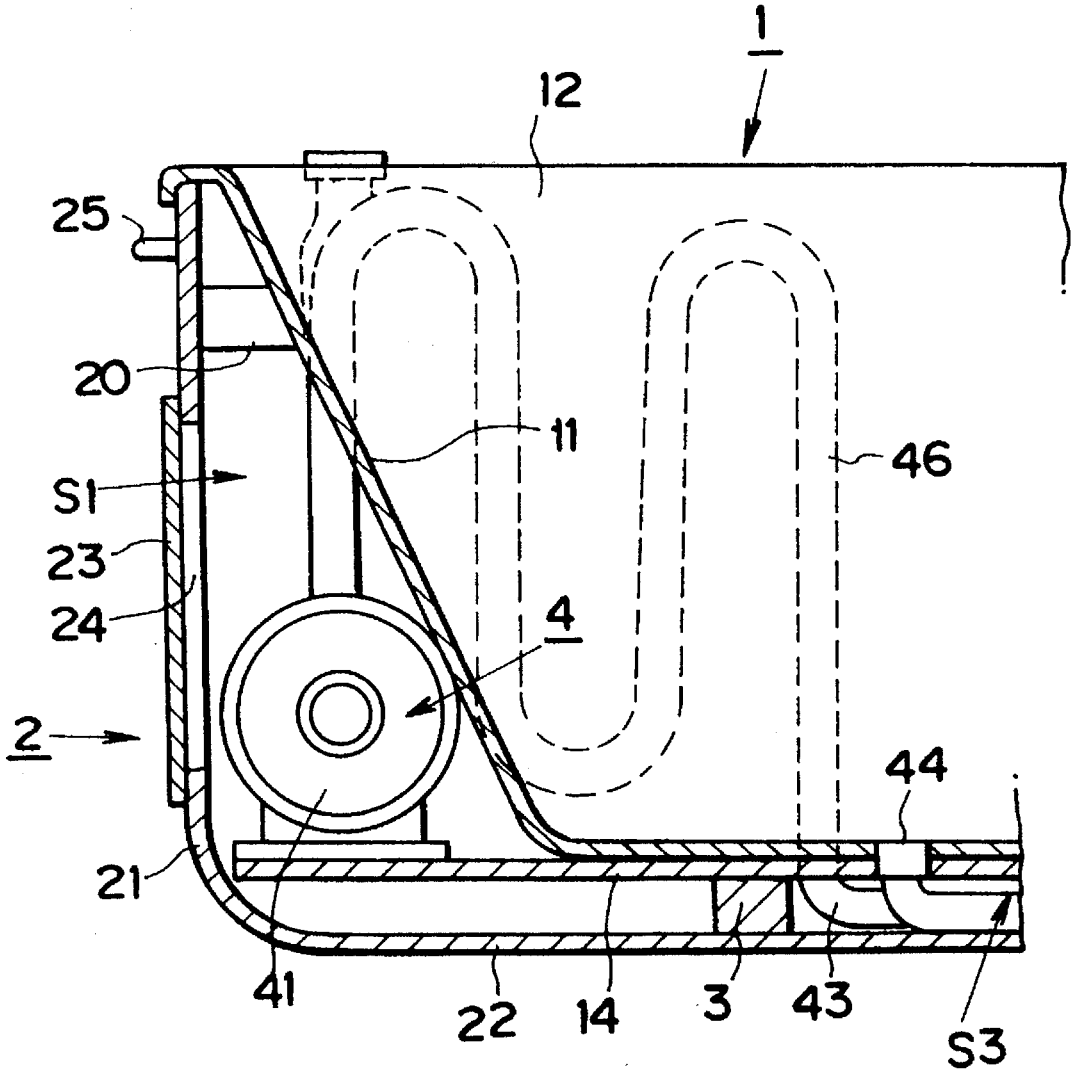
FIG. 5 is a sectional view of the principal portion of a second embodiment of this invention.

FIG. 5 shows the second embodiment of the bathtub unit according to this invention, in which the raised portion 46 of the pipe 43 is arranged in a zigzag form in the side space S2.

According to this embodiment using the zigzag portion 46, the hot water in the bathtub in no way flows backward into the air blowing pump without the check valves 47 as described above. Therefore, the bathtub can be made simple in structure and manufactured at a low cost.

Figure 6:
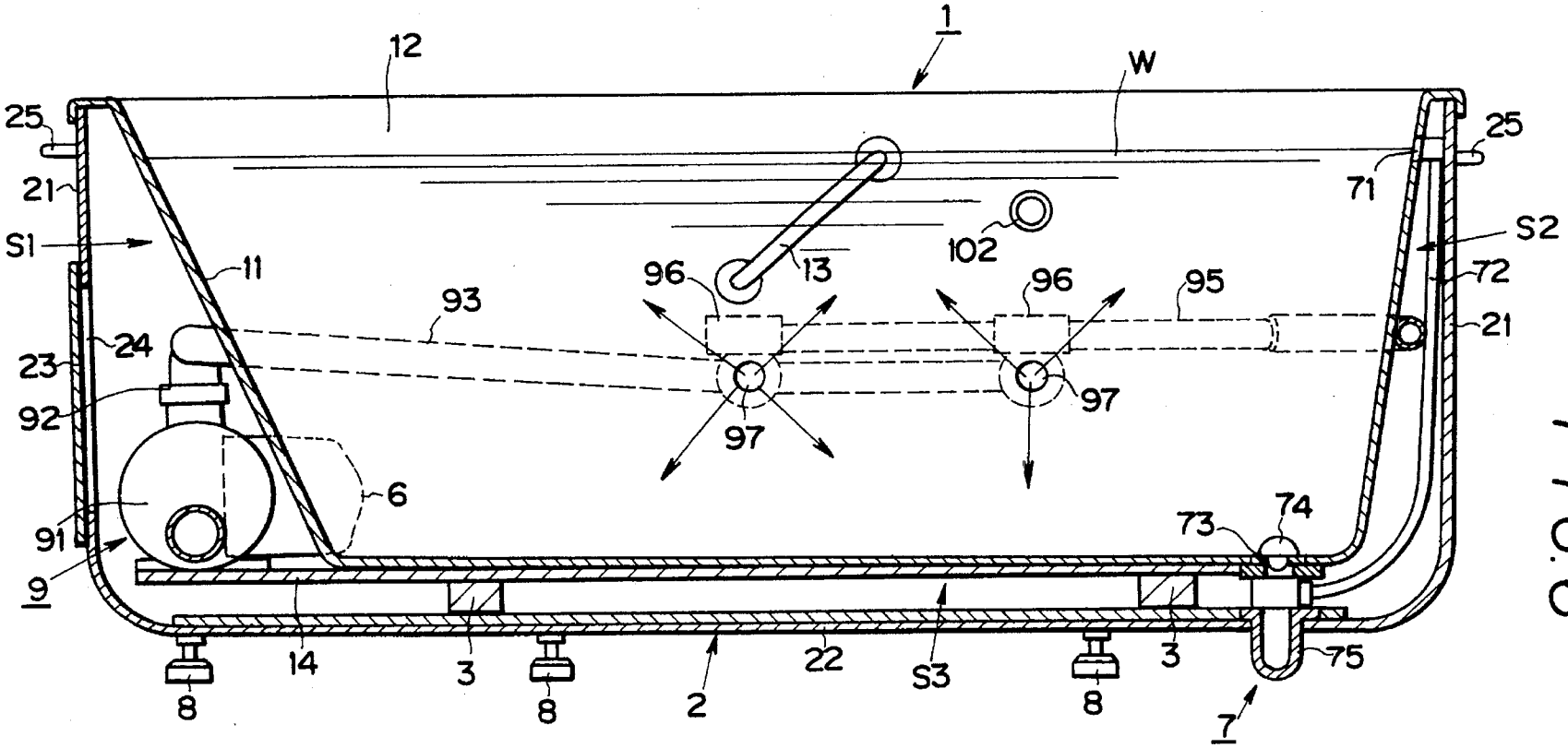
FIG. 6 is a sectional view of a third embodiment of this invention.
Figure 7:
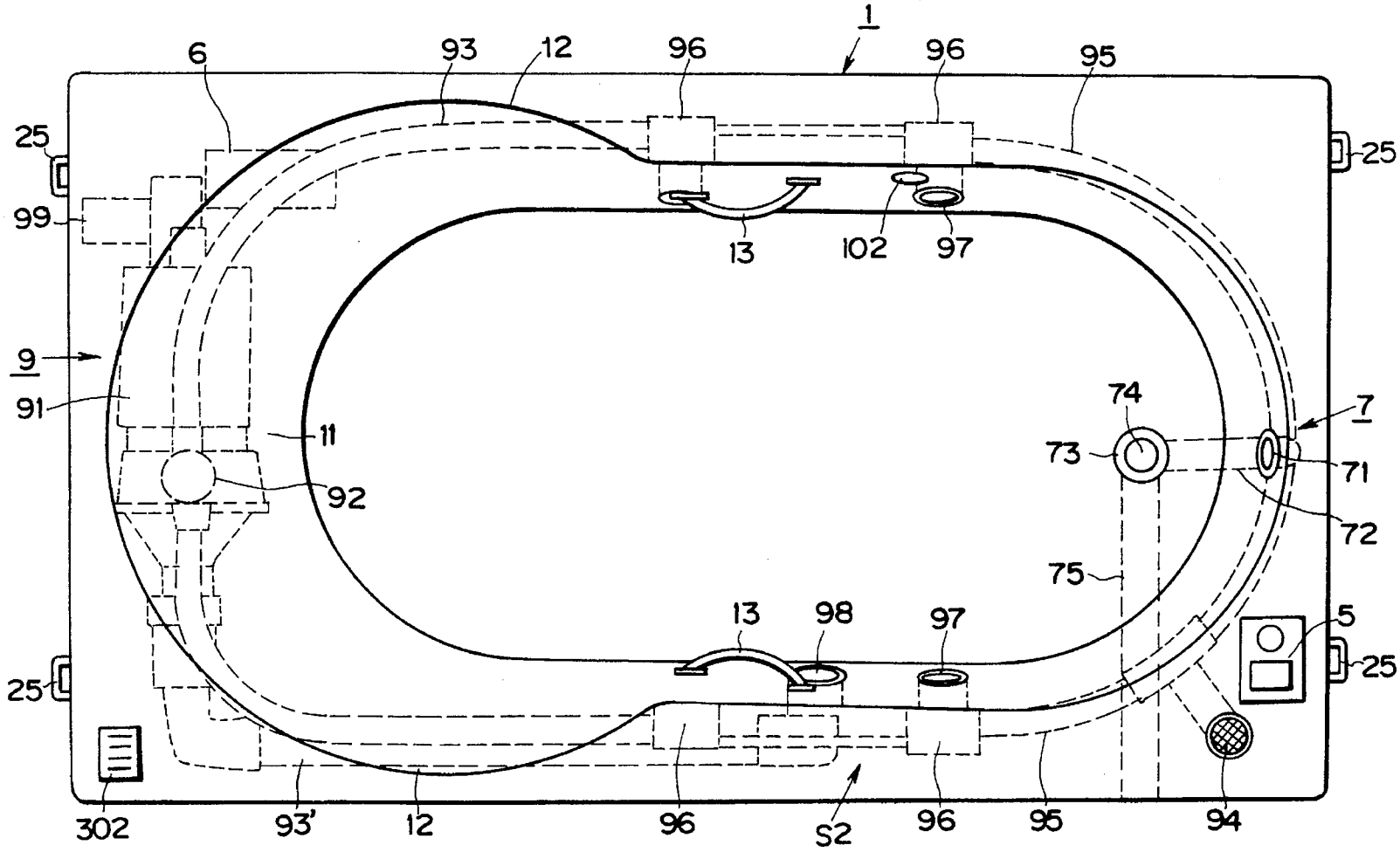
FIG. 7 is a plan view of FIG. 6.
Figure 8:
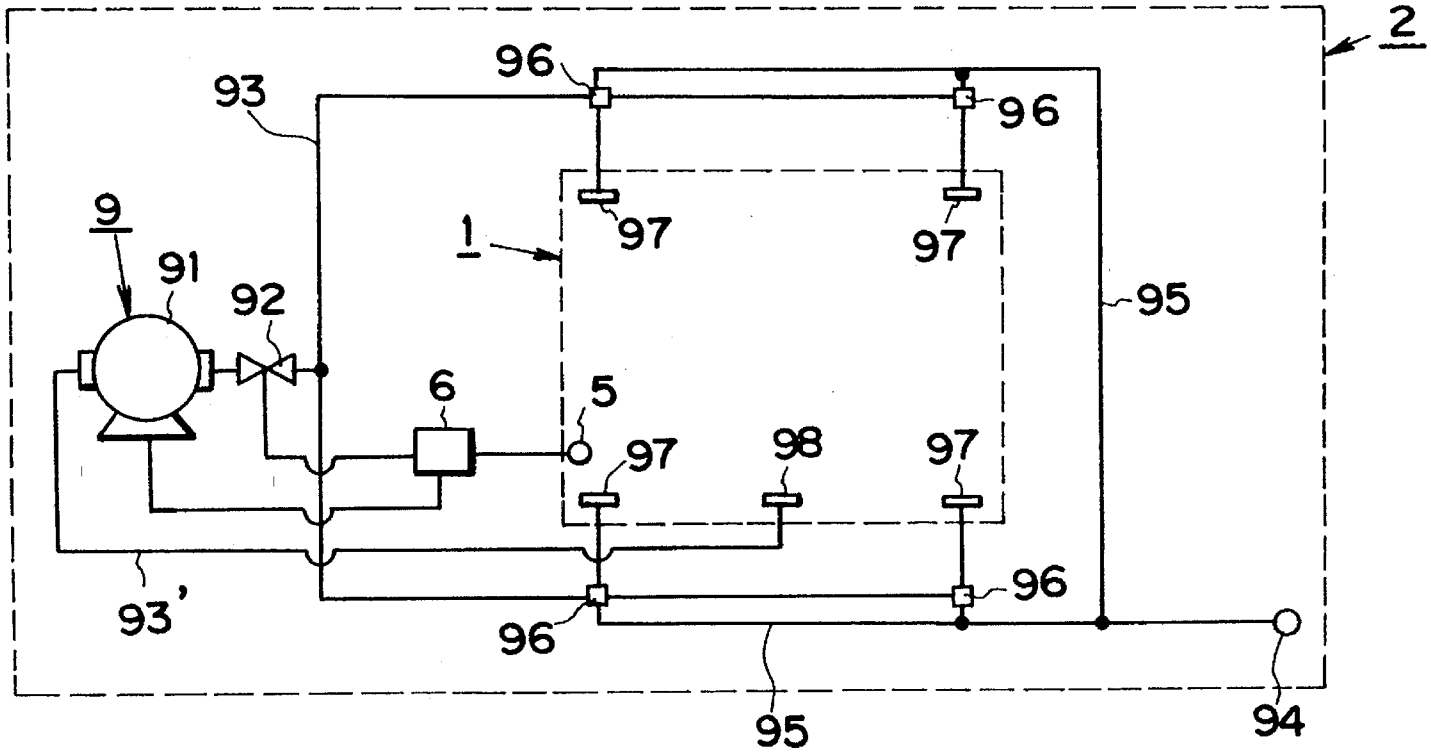
FIG. 8 is a piping diagram of the bathtub unit of FIGS. 6 and 7.

FIGS. 6 to 7 show the third embodiment of the bathtub unit according to this invention, having bubble-jet producing equipment 9 for emitting a jet of combined air bubbles and hot water into the bathtub.

The bubble-jet producing equipment 9 in this embodiment includes a jet pump 91, for producing forcibly pumping hot water W, which is disposed on the bottom support plate 14 fixed to the bottom of the bathtub 1 in the back accommodating space S1, a pressure control valve 92 connected to the jet pump 91 to control the flow of the hot water W, a hot water pipe 93 arranged in the side space S2, an air-inlet valve 94 having an inlet formed in the upper surface of the bathtub 1, an air pipe 95 arranged in the side space S2, a mixer 96 with which the hot water pipe 93 and the air pipe 95 are connected so as to mix the hot water and air introduced thereinto, a plurality of jet nozzles 97 connected with the mixer 96 and formed in the side walls of the bathtub 1 at fixed intervals, a hot water intake port 98 formed in one lateral side wall of the bathtub 1, a return hot water pipe 93' arranged between the hot water intake port 98 and the jet pump 91, and a cord reel 99 for an electric cord, which is disposed near the inspection hole 24 of the jacket receptacle 2.

Also, this embodiment has a function of emitting a jet of combined air bubbles and hot water and brings about a similar massaging effect to that brought about by the foregoing embodiments.

This embodiment does not include a bath liquid injecting means and filter mechanism as seen in the foregoing embodiments, but these elements may of course be added to this embodiment. Furthermore, this embodiment may employ the structure of the bubble-jet producing equipment in the first and second embodiments as described above. Besides, an audio system, a television set, a telephone and/or other amusement equipments may be attached to the bathtub unit of this embodiment.

As is apparent from the foregoing description, according to this invention, the following beneficial effects can be brought about.

Since the bathtub unit of this invention includes an integrated assembly of the bathtub and the jacket receptacle and incorporates the bubble-jet producing equipment, there can be provided a convenient bathtub unit having an excellent function of emitting a jet of air bubbles or hot water, which can be readily moved and transported to any location and easily assembled and installed without specific piping assembly operation. Furthermore, the bathtub unit of this invention can be easily handled, repaired and preserved.

Since the bubble-jet bathtub unit according to this invention has the means for injecting various bath liquids or an aromatic into the bathtub, and lighting means for illuminating the inside of the bathtub, bathing can be made more enjoyable.

It is further understood by those skilled in the art that the foregoing description relates to preferred embodiments of the disclosed device and that various changes and modifications may be made in the invention without departing from the spirit and scope thereof.

What is claimed is:

1. A portable bathtub unit that is capable of being moved at will to a desired location of use and that is devoid of plumbing connections to be connected to a water supply, said unit comprising:

a bathtub for containing water, said bathtub having bottom and side walls, an upper peripheral flange, and bubble jet nozzles in at least one of said walls;

a jacket receptacle having bottom and side walls;

said bathtub being positioned within said receptacle and defining therewith a double-wall structure having between confronting respective walls of said bathtub and said receptacle a back accommodating space, a front space and opposite lateral side space, and said bathtub and said receptacle being devoid of water supply plumbing connections or fixtures;

bubble-jet producing means for generating and emitting a jet of air bubbles into said bathtub, said means comprising an air blowing pump for drawing in open air and forcibly discharging such air, a pressure control valve for controlling the pressure of the air discharged from said air blowing pump, a pipe leading the air discharged from said air blowing pump to said bubble jet nozzles, a portion of said pipe being raised to extend to said flange and having an opening exposed therethrough and a cap removably closing said opening;

a driving controller operably connected to said air blowing pump for controlling operation thereof;

a filter unit for filtering water in said bathtub, and a pump for circulating water between said bathtub and said filter unit;

a steam mechanism including a steam producing device for producing and supplying steam into said bathtub;

a drain for draining water from said bathtub;

injecting means for injecting a bath liquid or an aromatic into said bathtub;

an illuminating means for illuminating said bathtub, said illuminating means including a light source spaced from said bathtub, an optical projecting means for emitting light into said bathtub, and optical fibers for transmitting light from said light source to said optical projecting means;

a cord reel supporting a reeled electric cord operatively connected to said air blowing pump and to be connected selectively to an electric source for selectively enabling power to be supplied to said air blowing pump;

said air blowing pump, said pressure control valve, said pipe portion, said driving controller, said filter unit, said steam mechanism, said injecting means, said light source and said cord reel all being accommodated within said back accommodating space;

a control panel having a switch operably connected to said driving controller for selectively controlling operation of said air blowing pump; and damper leg stands mounted on said receptacle for supporting said bathtub unit.

2. A portable bathtub unit according to claim 1, wherein said bathtub is formed in a substantially shallow ship bottom shape having a substantially trapezoidal cross section, and said side walls of said bathtub comprise a front side wall, lateral side walls and a back side wall that is inclined so as to form a backrest, said back accommodating space being between said backrest and a back side wall of said receptacle.

3. A bathtub unit according to clam 2, wherein said backrest is inclined at about 100° to 150°.

4. A bathtub unit according to claim 1, wherein said bubble-jet producing means further includes a jet pump for forcibly sending water from said bathtub back into said bathtub through said bubble jet nozzles.

5. A bathtub unit according to claim 1, wherein said pipe connecting from said air blowing pump to said bubble jet nozzles has therein said injecting means.

6. A bathtub unit according to claim 1, wherein said leg stands are made of porous metal, rubber or a hard plastic.

7. A bathtub unit according to claim 1, wherein said control panel is mounted on said flange.

8. A bathtub unit according to claim 1, wherein said flange has a U-shaped portion fitting over tops of said side walls of said receptacle.

9. A bathtub unit according to claim 8, wherein said U-shaped portion is fixed to said tops of said side walls.

10. A bathtub unit according to claim 1, wherein a back side wall of said receptacle has therein an opening providing access to said back accommodating space.

11. A bathtub unit according to claim 1, further comprising handles mounted on exteriors of said side walls of said receptacle, thereby enabling said bathtub unit to be lifted and moved.

12. A bathtub unit according to claim 1, further comprising casters on said bottom wall of said receptacle for facilitating movement of said bathtub unit.

13. A bathtub unit according to claim 1, wherein a further portion of said pipe has an up and down zigzag configuration.

* * * * *